US007011638B2

(12) United States Patent
Schuler et al.

(10) Patent No.: US 7,011,638 B2
(45) Date of Patent: Mar. 14, 2006

(54) DEVICE AND PROCEDURE TO TREAT CARDIAC ATRIAL ARRHYTHMIAS

(75) Inventors: Eleanor L. Schuler, Rio Rancho, NM (US); Claude K. Lee, Reno, NV (US)

(73) Assignee: Science Medicus, Inc., Albuquerque, NM (US)

( * ) Notice: Subject to any disclaimer, the term of this patent is extended or adjusted under 35 U.S.C. 154(b) by 476 days.

(21) Appl. No.: 09/992,967

(22) Filed: Nov. 14, 2001

(65) Prior Publication Data

US 2003/0176818 A1 Sep. 18, 2003

Related U.S. Application Data

(60) Provisional application No. 60/248,068, filed on Nov. 14, 2000.

(51) Int. Cl.
*A61H 1/00* (2006.01)

(52) U.S. Cl. ..... 601/46; 601/70; 601/72

(58) Field of Classification Search ..... 601/46, 601/56–58, 67–72, 73–83, 135
See application file for complete search history.

(56) References Cited

U.S. PATENT DOCUMENTS 4,632,095 A * 12/1986 Libin ..... 601/135
4,979,502 A * 12/1990 Hunt ..... 601/15
5,704,902 A * 1/1998 Vandenbelt et al. ..... 601/72
5,928,262 A * 7/1999 Harber ..... 606/204.35
6,203,470 B1 * 3/2001 Lundin et al. ..... 482/10

* cited by examiner

*Primary Examiner*—Jerome Donnelly
(74) *Attorney, Agent, or Firm*—Francis Law Group

(57) ABSTRACT

A non-invasive vagal stimulation device and method. The device comprises a body having a vibration member. The stimulation is created by the vibration member which has a vibratory rate that can be adjusted from being off to a preferred operating range. The non-invasive stimulation method consists of placing the non-invasive stimulation device in the vicinity of the carotid artery bifrication where arises a carotid sinus and body which contain afferent sensory nerves that travel to medulla oblongata of brain, and either applying pressure in place, or moving the device along the target arm. The method can be accomplished either with the vibration feature of the device turned on or off.

6 Claims, 3 Drawing Sheets

DEVICE AND PROCEDURE TO TREAT CARDIAC ATRIAL ARRHYTHMIAS

RELATED APPLICATION

This application is the non-provisional filing of provisional application Ser. No. 60/248,068, filed on Nov. 14, 2000, entitled "Device and Procedure to Treat Cardiac Atrial Arrhythmias."

BACKGROUND OF THE INVENTION

This invention relates to a device and method for non-invasively controlling human and animal hearts in a manner that treats emergency arrhythmias of the cardiac atrium.

Atrial arrhythmias are abnormal electrical contraction (beating) of the two thin-walled atrial chambers. The two smaller atrial chambers of the heart sit atop the two thick-walled large ventricular chambers. Those powerful ventricular chambers pump blood both to the lungs (right ventricle) and to the entire body (left ventricle). Atrial chambers have the job of pumping blood downwardly to fill the two ventricles before they contract (pump).

Arrhythmias (irregular beating or fibrillation) of atrial chambers can lead to serious performance deficit in the ventricles. Ventricles that receive less than adequate level of blood begin to contract (pump) at ever increasing rates per minute. Ventricles speed up because sensory information processed in the brain indicates that inadequate blood circulation is happening (i.e., inadequate oxygen being supplied). When heart beat cycles become too fast the heart can go into fibrillation which further cuts the oxygen supply and eventually leads to mortality.

Fibrillation is an exceedingly rapid, but disorganized, contraction or twitching of the heart muscle fibril electrical system that causes grossly inefficient contraction of the heart muscle (myocardium). Especially in the atrial chambers the twitching is vermicular (or wormlike) and tends to evolve into rapid circular electrical activation rather than the more normal slower linear conduction. Further understanding of heart fibrillation is that it is recurrent, involuntary and abnormal that prevents normal contraction (pumping action) to circulate blood. The heart muscle (myocardium) quivers during fibrillation and blood circulation falls off severely. The normally coordinated electrical contraction of the myocardium degrades to chaotic electrical conduction which seemly cannot correct itself without critical medicinal and/or electrical intervention.

Prompt treatment is the best way to return the heart to a normal rhythm. Patients usually receive treatment for atrial fibrillation in hospital emergency rooms. Since it takes time to arrive in the emergency room, patients often are in deteriorating medical condition. If there were a simple treatment that could be applied by the patient or a paramedic which tended to lower ventricular heart rate and take atria out of fibrillation the condition of the patient arriving at the emergency room would be better.

When atrial fibrillation (sometimes called A-fib) occurs in the atrial chambers a quivering caused by very fast circular wave-forms occurs within the thin cardiac muscles that make up the wall of the two chambers. The normal beat rate of about 80 beats per minute (bpm) can now rise to 400–500 BPM. Such fast, but weak beats, "churn" the blood and may cause blood-clots which can break-off and travel to the brain, causing a significant stroke risk.

Fibrillating atrial chambers are inefficient at pumping blood. As A-fib proceeds it retards blood circulation and impairs the entire body. Atrial fibrillation starves the ventricles for adequate blood supply. When the atrium are unable to supply adequate blood to the ventricles, then the entire body becomes endangered by insufficient oxygenation. Oxygen is carried by the blood's red cells and is transported by arteries to serve the entire body. In addition, an impaired returning venous blood circulation causes insufficient removal of waste products from all the organs and cells. Patients feel as if they are suffocating because of oxygen starvation so providing oxygen "early" is an important part of treatment.

The longer atrial fibrillation proceeds unchecked, the more likely death will occur. This dangerous process begins when blood does not fill the ventricles. In response, the brain instructs the ventricles to pump faster because not enough blood is circulating. Since the ventricles are pumping with only partially filled chambers bio-alarms go off in the brain and the patient begins having feelings of impending doom. The patient in atrial fibrillation becomes anxious at the prospect of death as his ventricles accelerate their beat. Patients in such extremis are most often unable to do anything to help themselves and faint or collapse, and in a sense, are witness to their own death. If the patient had a simple treatment device it might be possible to reverse a potentially lethal outcome.

Atrium(s) which are fibrillating certainly are weakly pumping ever more insufficient blood to the ventricles. Hence the cardiac ventricles respond by gradually beating (pumping) faster and faster (tachycardia) trying to reach hydrodynamic balance. The atrium could be beating at 400 to 500 bpm and the ventricles at something like 150 to 180 bpm. Such powerful and rapid ventricular beats are felt in one's pulse and often as chest palpitations (irregularly or regular pounding heart). Since normal pulse is in the range of 60 to 90 for a resting human, it becomes alarming at 180 bpm. During fibrillation, the electrical system of the heart is disorganized, erratic and the normal rhythmic beat is lost. Most atrial fibrillation terminates spontaneously or is converted to a normal rhythm in a hospital emergency room. However, if the A-fib continues on, it can deteriorate by effecting the two ventricular chambers of the heart, as previously described.

Life threatening events begin to occur as ventricles join in the emergency. Breathing becomes more difficult with beginning feelings of suffocation. Often the patient becomes dizzy, faints or collapses. Patients may complain of chest pain or heart palpitations, if they are conscious. Once the racing ventricles decay to around 200 bpm they can begin mortally fibrillating. Each passing minute of total heart fibrillation is 10% of death. In 6 or 7 minutes brain damage is occurring and by 10 minutes the patient is indeed dead. So a fibrillating atrial event, in time, will decay to ventricular fibrillation and lead to certain death, unless corrected.

If the patient can arrive at the hospital emergency room before ventricular crisis happens there are two modes of treatment. One treatment is to use high-voltage electrical defibrillation paddles to try and convert the arrhythmia(s) to normal fibrillation. A second treatment is to use certain calcium antagonists medications such as Diltiazem or Verapamil to slow down the conduction circuits.

However, the medication technique must be done early in the atrial fibrillation since effectiveness usually takes a period of time, even hours, to return the heart to normal rhythm. Once the patient is stabilized other treatments include burning out conductive circuits in the atrial muscle with lasers or ultrasound to limit its ability to conduct in certain areas. This treatment can fail if it destroys critical elements of the atrial circuitry and potentially requires emergency implantation of a heart pacemaker to save the patient.

The atrium can have other rhythm disturbances that also require medical treatment. One of these is called "flutter." When this occurs, the patient says, "it feels like a bird is in my chest flapping its wings!" This is an appropriate and exacting description. Breathing is somewhat labored (breathlessness) and the condition can occur as alternating flutter and A-fib, called "fib-flutter." Flutter consists of slower beat rates of about 200 to 300 bpm within the atrium. Flutter is usually treated with medications to convert back to normal rhythm. Flutter alone is usually more of a nuisance to a patient since hemodynamic compromise usually does not occur. Still other disturbances include chaotic and multifocal atrial tachycardia which also can decay into fibrillation. In addition there is totally unexpected paroxysmal fibrillation of a sudden onset, with intermittent rapid and irregular atrial rhythm due to multiple reentrant electrical wavelets in the atrial contractile muscle.

Atrial fibrillation can also be sustained at beat rates of about 350 bpm or lower down to 120 bpm and is refractory to treatment. Such fibrillation can go on for hours or even days without mortality. Such patient may have recurrent attacks of A-fib often without endangering hemodynamics of the ventricles. These patients, as time goes on, often must have a pacemaker implanted to prevent a mortal event during one of their A-Fib episodes. The main risk is embolic (tendency to form clots), and hence anticoagulation is needed. If an embolus (clot) forms it can be the precursor of a dangerous stroke. Otherwise, clotting prevention is approached by having patients take an aspirin every day or a prescribed blood-thinner, if they have a potential of having recurrent fibrillation attacks. The atrium otherwise can contact (beat) with poor muscle tone or pump too fast or slow requiring a medication program or pacemaker implantation.

There is little most patients can do to treat atrial fibrillation events outside the hospital emergency room. There are more than 2,000,000 people in the United States that experience A-Fib annually. When this happens the patient is rushed to an emergency room for treatment. It is best to treat A-Fib the moment after it starts, since conversion back to normal heart rhythm can then occur more easily. As it runs on, the hemodynamics and the brain's reaction to events, deteriorate the patient's medical condition with time.

Once the aberrant rhythm goes on for a while it becomes intrenched and more difficult to convert. Safe, rapid treatment by the patients themselves would be most productive. If patients still requires hospitalization they would likely be in better condition from self-treatment than if they did nothing and were transported in an ambulance which would provide only oxygen and hook-up an EKG to monitor cardiac status.

The vagus nerve in the case of atrial fibrillation treatment is actually the out put of "efferent" nerve. The carotid artery bifraction (where the artery splits the blood suppy into two arterial pathways) contains two sensors that we are stimulating. They are the carotid sinus and the carotid body which have sensory nerves that lead to the medulla oblongata with instructions. Afferent nerve is an input informational nerve that provides information to the medulla to help it select the appropriate out put signal that travels, in this case, to the heart.

The vagus nerve contains both afferent and efferent nerves in its bundle. There are some 100,000 fibers in the vagus. About 75% of the fibers are afferent sensors. The balance are the output efferent nerves that travel to all the internal organs that keep the body alive.

The present invention is designed to stimulate nerves leading to circuits that would calm aberrant rhythms in the heart and offer an immediate treatment modality for patients in their homes or businesses and by paramedics.

SUMMARY OF THE INVENTION

The invention provides a treatment device comprising a vibration member shaped to stimulate the carotid body and sinus. Preferrably, treatment device contains a motor connected to the vibration member. The motor can be set at varying speeds to alter the vibratory speed. The treatment device includes a housing within which the motor is located and from which the vibration member extends. The vibration member includes a vibration tip, which is used to contact the body. In one embodiment of the device, the vibration tip is approximately one-half inch wide by one-quarter inch deep and one inch long.

Additionally, the housing has handgrips to keep the device from slipping out of the operator's hand, as well as, at least one display. The display(s) can indicate the operation of the apparatus and/or the rate of vibration of the device, as well as other information.

According to the method for using the treatment device, the body is contacted in the vicinity of the carotid body and sinus afferent nerve sensors that carry coded signals to the medulla oblongata and light pressure is applied in such vicinity to stimulate the carotid body and sinus. The device has a vibration member and the pressure can be applied either with the vibration member on or off. When applying light pressure with the device, the device can also be moved along at least a portion of the central area starting just below the angle of the jaw below the ear to a region of the clavicular notch at the top of the sternum. The region to be stimulated is the middle region between c. notch and jaw angle.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
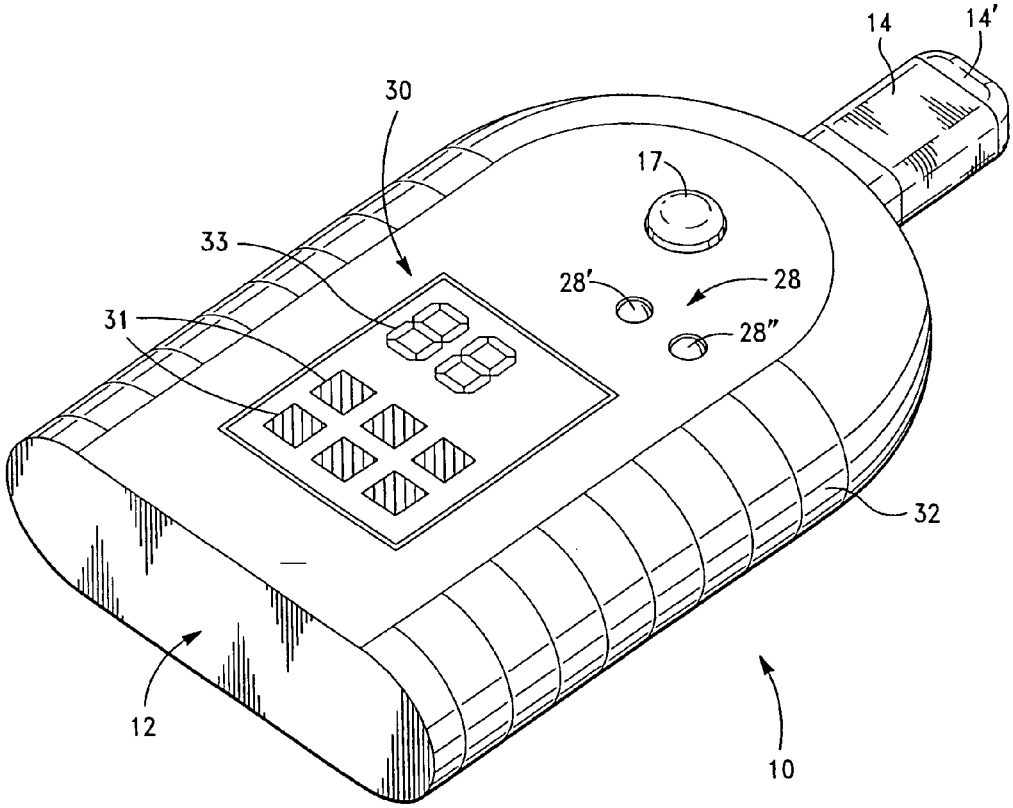
FIG. 1 is a front perspective view of one from of the device according to the invention.

For the purpose of promoting an understanding of the principles of the invention, references will be made to the embodiments illustrated in the drawings. It will, nevertheless, be understood that no limitation of the scope of the invention is thereby intended, such alterations and further modifications in the illustrated device, and such further applications of the principles of the invention illustrated herein being contemplated as would normally occur to the one skilled in the art to which the invention relates.

The invention comprises to a device and method for non-invasively controlling human and animal hearts in a manner that treats emergency arrhythmias. It is used to treat the right side carotid-body and carotid-sinus which reside at the junction of the internal and external carotid artery which travels between the heart and the brain. These structures are found within the neck and arise so that they can be stimulated through the skin. Both the body and sinus of the carotid artery have afferent nerve fibers which travel on afferent neuron axons, possibly joining the glossopharyngeal afferent nerves until such signal enters the solitary-tract-nucleus, dorsal-vagal-nucleus and potentially the Olive processes and other nuclei, all located within the medulla oblongata.

The signals to the medulla are caused by stimulation with the invention as described below. Such signals provide information which is integrated and processed within the medulla and new coded signals are generated by the ambiguous nucleus via the vagus-efferent-nerve going to the hear nerve plexis. Such signals (instructions), in the form of a coded analog signals, then rapidly travel along the efferent axons of the vagus nerve leading to the heart where it enters the cardiac-nerve-plexus. At the cardiac-nerve-plexus the signal is routed to instruct (signals) the cardiac muscle (Myocardium) to slow down the conduction that is causing the Atrium chambers to fibrillate.

The conduction system signals the ventricles to bring its conduction activation to a slower beat-rate (contraction cycle). This slowdown is commensurate with the availability of adequate chamber(s) blood filling by the now slower atrium(s) above. The ventricular system then gradually slows down its contractions as the body becomes properly oxygenated.

The use of the invention is for slowing of the electrical conduction in various atrial parts of the myocardium. This directly results in bringing the heart toward more normal function, results in attaining normal blood circulation and makes the patient feel better and out of crisis.

Figure 3:
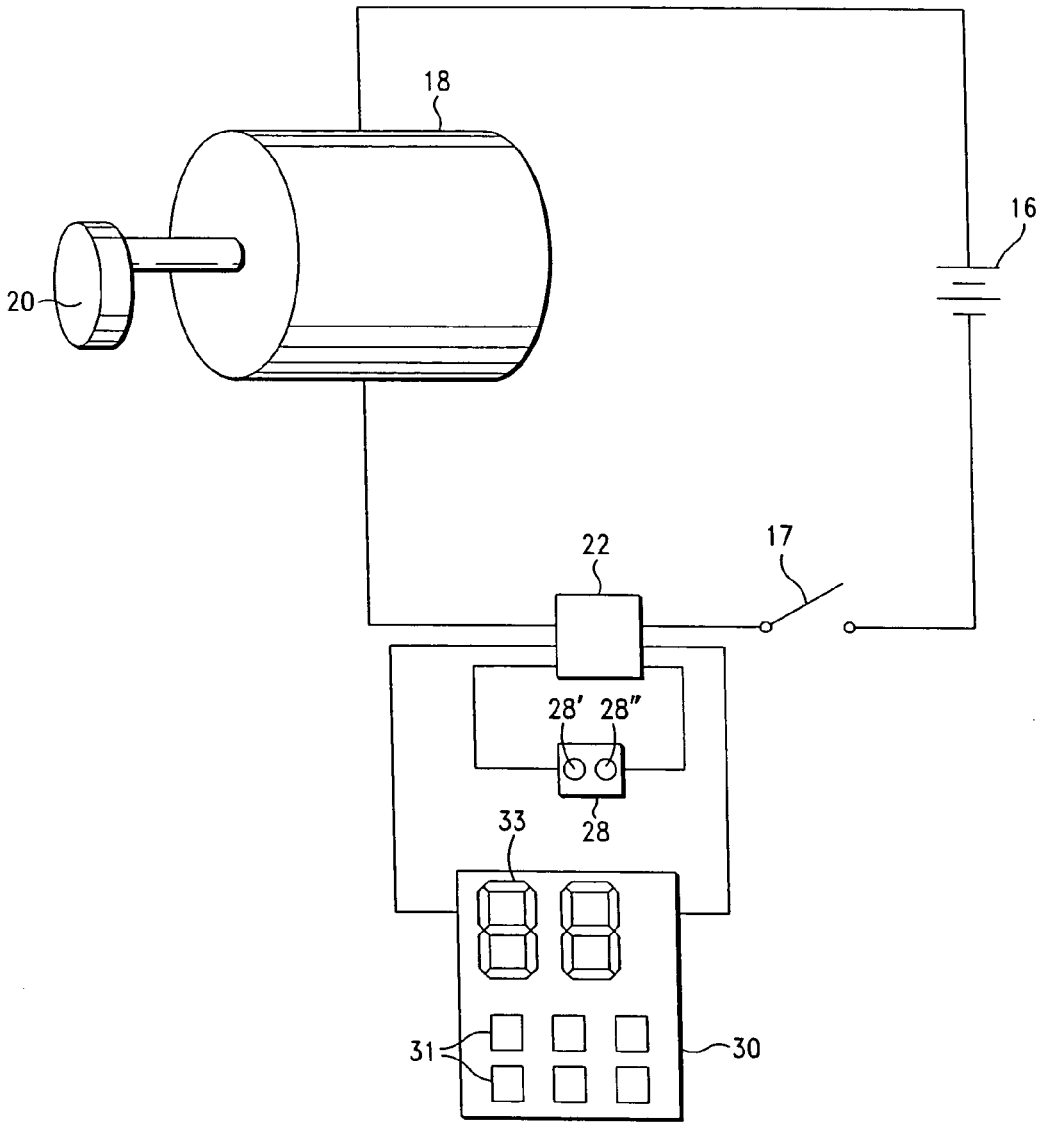
FIG. 3 is a schematic of one form of simple circuitry for operating the device according to the invention.

One form of the device 10 for non-invasively treating atrial arrhythmia, as shown in FIG. 1, is comprised of a hollow housing 12 having internal circuitry as shown in FIG. 3. The housing 12 includes a vibration member 14 at one end. In the interior of the housing 12 is a power source 16 which is operably connected to a motor 18. The power source 16 may comprise a battery or any other self-contained source of energy, or could be connectable to another source, such as an A-C current. A switch 17 is used to complete the circuit to activate the motor 18. The motor 18 drives an eccentric 20 or any other vibration-inducing apparatus which is operably connected to the vibration member 14 in any conventional fashion.

The motor 18 is operably connected to a control module 22, which can comprise any conventional control preforming the functions as described herein. The control module 22 adjusts the rate at which the motor 18 operates the vibration member 14 via the eccentric 20.

The device 10 further includes first and second displays 28 and 30. The first display 28 is operably connected to the control module 22 and provides a visual indication of whether the device 10 is on or off. In one embodiment of the invention the first display 28 consists of indicator lights, such as lights 28' and 28". Alternatively, the first display 28 may also be a liquid crystal display (LCD) or any suitable display. The second display 30 is operably connected to the control module 22 and provides a visual indication of the rate at which the vibration member 14 is vibrating. The control module 22 can be programed so that the second display 30 provides indications in terms of bpm or any other unit of measure suitable to the operator. In one embodiment of the invention, the second display 30 consists of a series of indicator lights 31 and a digital read-out 33. Alternatively, the second display 30 can also be a LCD display, digital display, or any other suitable type of display that will tell the operator the rate at which the device 10 is operating.

The vibration member 14 is an extension at one side of the housing 12 and is operably connected to the motor 18. The vibration member 14 can be any shape or size so long as the vibration member 14 is able to stimulate the target zone 24 comprising afferent nerves of the carotid body and sinus. In one embodiment of the present invention the vibration member 14 includes a tip 14' whose dimensions are approximately one-half inch wide by one-quarter inch deep by more than one inch long. It could be other shapes, as well, so long as the shape permits vagus nerve stimulation.

The housing 12 further includes handgrips 32 which make it easier to hold the device 10 while being used by the operator. The handgrips 32 may be comprised of any suitable material, or combination of materials, so long as the material reduces the risk of slippage. The handgrips 32 may thus be comprised of rubber, molded plastic, or any other suitable material.

Figure 2:
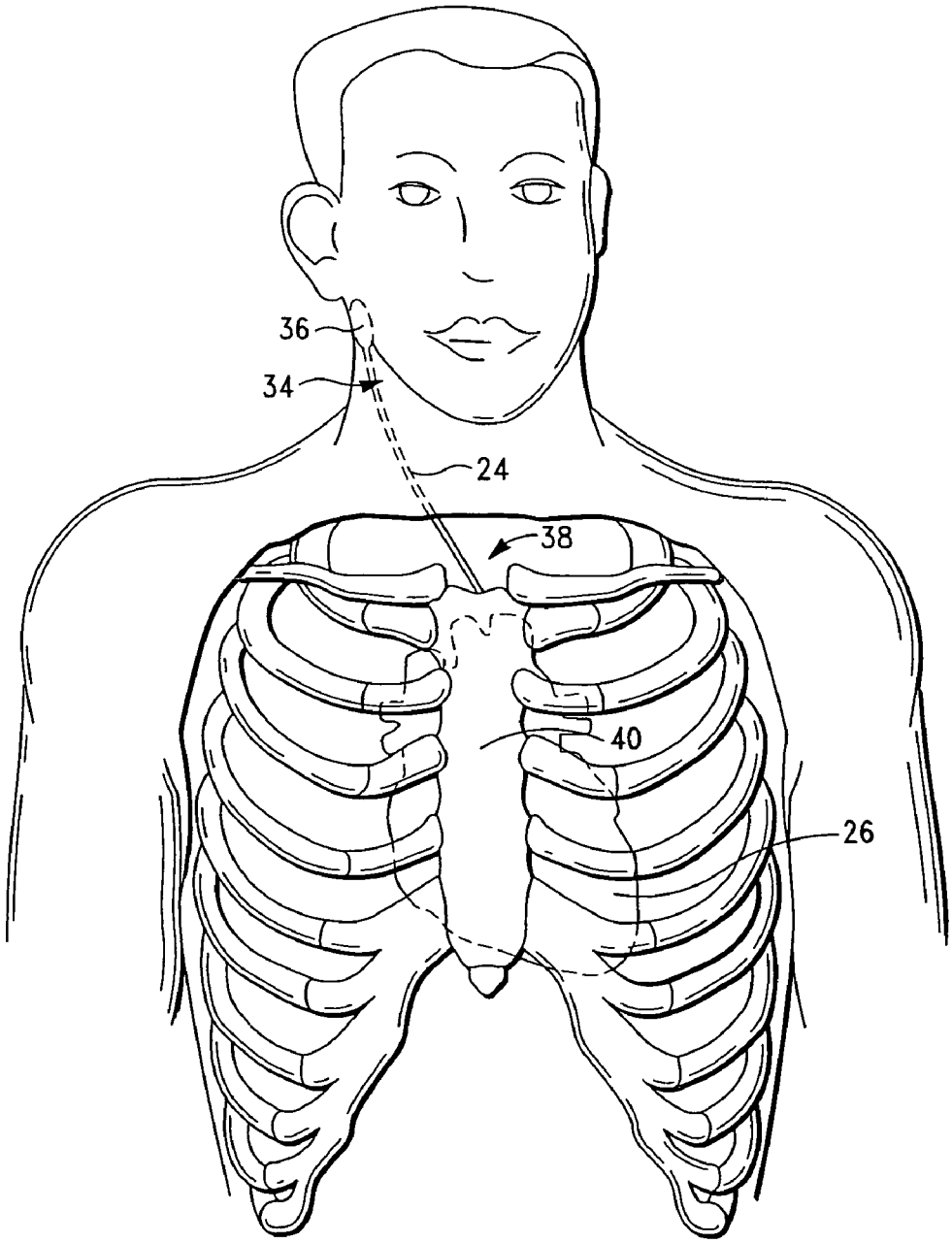
FIG. 2 is a schematic diagram of the vagus nerve with relation to how and where the device according to the invention will be operated.

The process by which one non-invasively treats atrial arrhythmia using the device 10, described above, consists of the following steps:

The switch 17 is used to complete the circuit to activate the motor 18, and the device 10 begins vibrating. The device 10 is then placed on the body in the vicinity of the target zone 24. The preferred method for using the device 10 is for the vibration member 14 to be activated such that the vibration acts to stimulate the target zone 24 (which is depicted in FIG. 2), which in turn will affect the atrial arrhythmia. A vibration rate between about 60 and 80 beats per minute (bpm) is considered ideal. The device 10 can be adjusted to vibrate at a rate outside of this range. However, a vibration rate below this range may result in the patient's heart 26 adjusting to a rate slower than normal and may cause the patient to feel faint and possibly pass out. A vibration rate in excess of the recommended range may be dangerous because it might result in the patient's heart 26 adjusting to a rate faster than normal and will create a sense of panic and urgency in the patient.

An alternate method for using the device 10 consists of activating the device 10 as above. However, instead of just placing the device 10 on the target zone 24, the device 10 is directed along at least a portion of the area of the target zone 24 which runs along an area starting just below the angle of the jaw 34 below the ear 36 to a region of the clavicular notch 38 at the top of the sternum 40. Moving the device 10 in the region of the target zone 24 may increase the chances of proper nerve stimulation.

In the alternative, the vibration feature of the device 10 is not activated and the vibration member 14 is rubbed along the target zone 24. This, however, is not the preferred method of use for the device 10 because the level of pressure needed to stimulate the target zone 24 when the vibration feature is off is uncertain. Too much pressure may result in breaking up fat deposits in the target zone 24, which may be harmful to the patient. By utilizing the vibration feature, the operator can set the vibration to a specific level and simply needs to place the device 10 in the target area located at bifracation of the target zone 24. This method both takes the heart 26 out of atrial arrhythmia and also slows the beat at which the heart 26 will set itself to match the vibration level of the device 10, which is why it is important, as stated above, that the device 10 is ideally set within the range of about 60–80 bpm.

Various features of the invention have been particularly shown and described in connection with the illustrated embodiments of the invention. However, it must be understood that these particular products, and their method of manufacture, do not limit but merely illustrate, and that the invention is to be given its fullest interpretation within the terms of the appended claims.

We claim:

1. A method for non-invasively treating cardiac irregularities via stimulation in a target zone comprising afferent nerves of the carotid body and sinus on the right or left side of the human neck, comprising the steps of:

providing a device shaped to contact the neck in the vicinity of the target zone;

applying pressure in the vicinity of the target zone to cause nerve stimulation.

2. The method according to claim 1, wherein the device includes a vibration member, and said pressure can be applied with the vibration member of the device turned on.

3. The method according to claim 1, including a vibration member, and in which the step of applying pressure includes moving the vibration member along at least a portion of the target zone located centrally between an area starting just below the angle of the jaw below the ear to a region of the clavicular notch at the top of the sternum.

4. The method according to claim 1, including target zone stimulation using vibration when applying pressure.

5. A method for non-invasively treating atrial irregularities via nerve stimulation, comprising the steps of:

applying pressure in the vicinity of a target zone comprising afferent nerves of the carotid body and sinus with a device; and maintaining pressure for a period of time sufficient to reduce the atrial arrhythmia.

6. The method according to claim 5, including target zone stimulation using vibration when applying pressure.

* * * * *